US008369739B2

(12) United States Patent
Kaneyama

(10) Patent No.: US 8,369,739 B2
(45) Date of Patent: Feb. 5, 2013

(54) INTERMEDIATE TRANSFER UNIT AND IMAGE FORMING APPARATUS INCLUDING THE SAME

(75) Inventor: Kiyotoshi Kaneyama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 573 days.

(21) Appl. No.: 12/559,881

(22) Filed: Sep. 15, 2009

(65) Prior Publication Data

US 2010/0150607 A1 Jun. 17, 2010

(30) Foreign Application Priority Data

Dec. 11, 2008 (JP) ..... 2008-315803

(51) Int. Cl.
*G03G 15/00* (2006.01)

(52) U.S. Cl. ..... 399/107; 399/110; 399/121

(58) Field of Classification Search ..... 399/110, 399/111, 116, 108, 117, 113, 107
See application file for complete search history.

(56) References Cited

U.S. PATENT DOCUMENTS

2006/0251444 A1* 11/2006 Ozawa et al. ..... 399/101
2007/0048005 A1* 3/2007 Nakano et al. ..... 399/110

FOREIGN PATENT DOCUMENTS

JP 2001-341883 12/2001
JP 2003-043764 2/2003
JP 2006-267500 10/2006

* cited by examiner

*Primary Examiner* — Walter L Lindsay, Jr.
*Assistant Examiner* — Roy Y Yi
(74) *Attorney, Agent, or Firm* — Sughrue Mion, PLLC

(57) ABSTRACT

An intermediate transfer unit includes an intermediate transfer belt that is configured to be rotated; a belt support that supports the intermediate transfer belt; a housing that receives the belt support on which the intermediate transfer belt is mounted; and a belt protecting member that is provided on the belt support and is urged by elastic member so as to cover edge of the intermediate transfer belt in a width direction thereof, wherein the belt support is formed to be swingable with respect to the housing, end of the belt protecting members is positioned so as to cover the edge of the intermediate transfer belt in the width direction while the belt support is received in the housing, and the end of the belt protecting member is withdrawn to an outside of the belt support while the belt support is swung with respect to the housing.

6 Claims, 11 Drawing Sheets

INTERMEDIATE TRANSFER UNIT AND IMAGE FORMING APPARATUS INCLUDING THE SAME

CROSS-REFERENCE TO RELATED APPLICATIONS

This application is based on and claims priority under 35 U.S.C. §119 from Japanese Patent Application No. 2008-315803 filed on Dec. 11, 2008.

BACKGROUND

1. Technical Field

The present invention relates to an intermediate transfer unit and an image forming apparatus including the intermediate transfer unit.

2. Related Art

Recently, the so-called intermediate transfer image forming apparatus has been well known as a color image forming apparatus, such as a color copier or a color printer, to which an electrophotographic method is applied. The intermediate transfer image forming apparatus includes a plurality of image forming units that corresponds to colors, such as yellow (Y), magenta (M), cyan (C), and black (K). In the intermediate transfer image forming apparatus, color toner images, which are sequentially formed on photosensitive drums of the image forming units, are initially transferred so as to overlap onto an endless intermediate transfer belt by initial transfer devices that are disposed to face the respective photosensitive drums. Then, the overlapping color toner image, which has been transferred to the intermediate transfer belt, is secondarily transferred to a recording medium by a secondary transfer device. After that, the color toner image is fixed to the recording medium by heating and pressing, so that a color image is formed.

SUMMARY

According to an aspect of the invention, there is provided an intermediate transfer unit including:

an intermediate transfer belt that is configured to be rotated, a toner image being transferred to a surface of the intermediate transfer belt;

a belt support that supports the intermediate transfer belt so as to allow the intermediate transfer belt to be replaceable;

a housing that receives the belt support on which the intermediate transfer belt is mounted; and a belt protecting member that is provided on the belt support and is urged by elastic member so as to cover edge of the intermediate transfer belt in a width direction thereof, wherein the belt support is formed to be swingable with respect to the housing, end of the belt protecting member is positioned so as to cover the edge of the intermediate transfer belt in the width direction while the belt support is received in the housing, and the end of the belt protecting member is withdrawn to an outside of the belt support while the belt support is swung with respect to the housing.

BRIEF DESCRIPTION OF THE DRAWINGS

Exemplary embodiments of the present invention will be described in detail based on the following figures, wherein.

DETAILED DESCRIPTION

An exemplary embodiment of the invention will be described below with reference to drawings.

Figure 1:
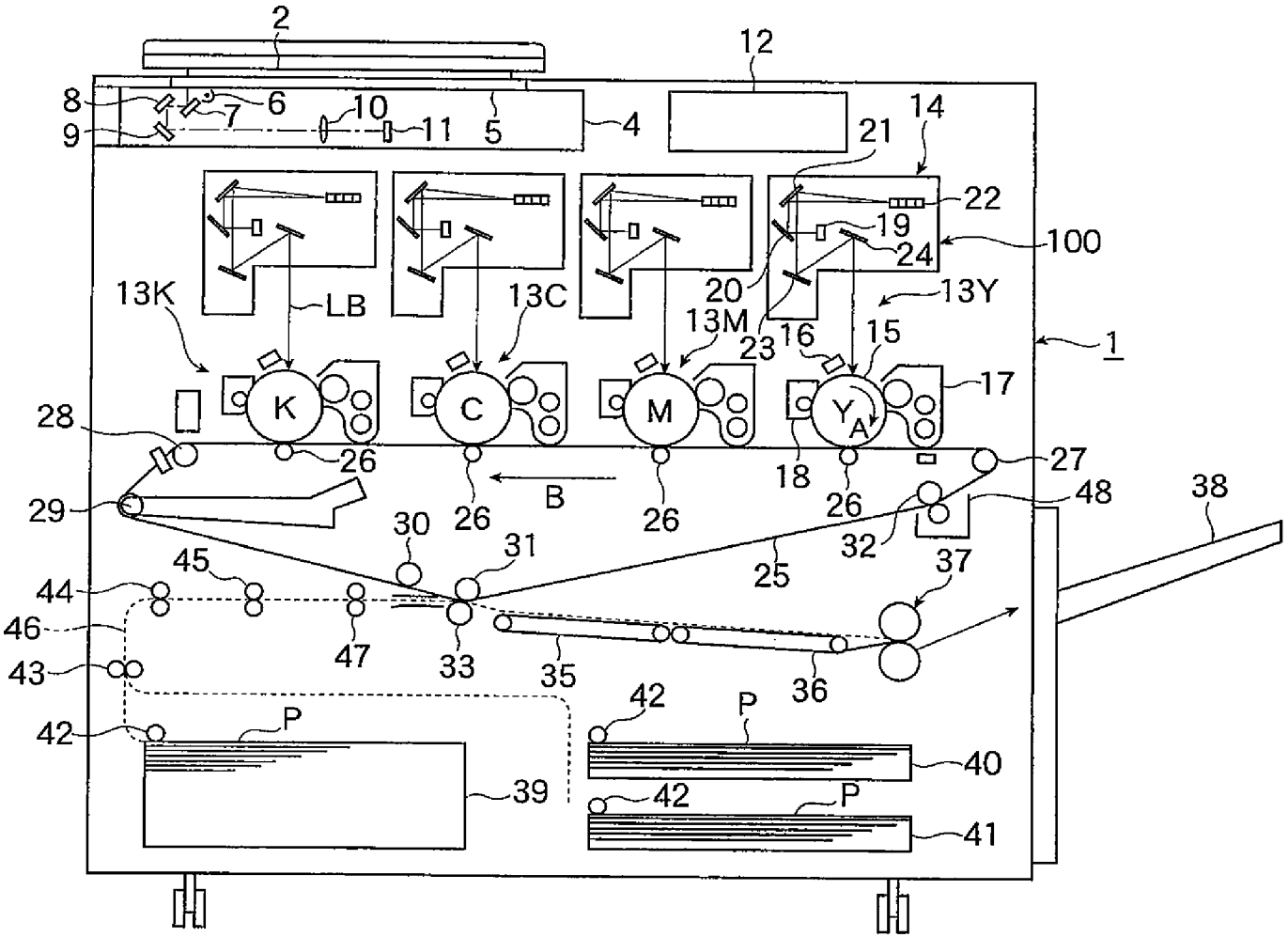
FIG. 1 is a schematic view showing the configuration of a tandem type image forming apparatus to which the exemplary embodiment of the invention may be applied.

First, the configuration of an image forming apparatus to which the exemplary embodiment of the invention may be applied will be described with reference to FIG. 1. Herein, FIG. 1 is a schematic view showing the configuration of a tandem type color electrophotographic copier to which the exemplary embodiment of the invention may be applied. In addition, the tandem type color electrophotographic copier includes an image input terminal. However, a facsimile machine or a color printer that does not include an image input terminal and that forms an image on the basis of the image data output from a personal computer (not shown) or the like may be used as an image forming apparatus.

In FIG. 1, reference numeral 1 denotes an image forming apparatus body of a tandem type color electrophotographic copier, and the image forming apparatus body 1 includes an image input terminal (IIT) 4, which reads out the image of a document 2, at an upper end portion thereof. An image processing system (IPS) 12 and an image output terminal (IOT) 100 are provided in the color electrophotographic copier body 1. The image processing system performs predetermined image processing on the image data that is output from the image input terminal 4, a personal computer (not shown), or the like, or the image data that is sent through a phone line, a LAN, or the like. The image output terminal outputs an image on the basis of the image data on which the predetermined image processing is performed by the image processing system 12.

An image of a document 2 that is pressed against a platen glass 5 by a platen cover 3, or a document that is automatically conveyed by an automatic document conveying device (not shown) is read in the image input terminal 4. The image input terminal 4 illuminates the document 2 which is placed on the platen glass 5 with a light source 6. The image input terminal scans and exposes a reflected-light image, which is reflected from the document 2, to an image input element 11, which is formed from a CCD or the like, via a reduction optical system, which includes a full-rate mirror 7, half-rate mirrors 8 and 9, and an imaging lens 10. Then, the image input terminal reads the color reflected-light image of the document 2 with a predetermined dot density (for example, 16 dot/mm) with the image input element 11.

The color reflected-light image of the document 2 which is read by the image input terminal 4 is sent to the image processing system 12 as document reflectance of three colors, for example, red (R), green (G), and blue (B) (reflectance of each color expressed in 8 bits). In the image processing system 12, predetermined image processing, such as shading correction, misalignment correction, brightness/color space conversion, gamma correction, frame erasure, and color/movement editing, are performed on the reflectance data of the document 2.

Further, as described above, the image data on which the predetermined image processing has been performed by the image processing system 12 is converted into document data of color gradation (raster data) of four colors, that is, yellow (Y), magenta (M), cyan (C), and black (K) (gradation of each color expressed in 8 bits). The document color gradation data is sent to exposure devices 14Y, 14M, 14C, and 14K of respective image forming units 13Y, 13M, 13C, and 13K that correspond to yellow (Y), magenta (M), cyan (C), and black (K) as described below. In the exposure devices 14Y, 14M, 14C, and 14K, image exposure is performed by a laser beam LB in accordance with the document color gradation data that corresponds to a predetermined color.

In the image forming apparatus body 1, as described above, tour image forming units 13Y, 13M, 13C, and 13K corresponding to yellow (Y), magenta (M), cyan (C), and black (K) are disposed in line at regular intervals in a horizontal direction.

These four image forming units 13Y, 13M, 13C, and 13K have the same structure. The image forming unit mainly includes a photosensitive drum 15 that is rotationally driven in a direction indicated by an arrow A at a predetermined speed and functions as an image holding member, a scorotron 16 that uniformly charges the surface of the photosensitive drum 15 with electricity, an exposure device 14 that forms an electrostatic latent image on the surface of the photosensitive drum 15 by scanning and exposing the surface of the photosensitive drum with a laser beam according to the image information of each color, a developing device 17 that develops the electrostatic latent image formed on the photosensitive drum 15, and a drum cleaning device 18 that removes any residual toner remaining on the surface of the photosensitive drum 15 after transfer.

In the exposure device 14, a semiconductor laser 19 is modulated in accordance with the document color gradation data, so that a laser beam LB is emitted from the semiconductor laser 19 in accordance with the gradation data. Then, the laser beam LB is emitted from the semiconductor laser 19 and reflected by reflection mirrors 20 and 21 to a rotary polygon mirror 22, which performs reflection scanning. Then, the photosensitive drum 15 functioning as an image holding member is scanned and exposed by the laser beam LB after being reflected by the reflection mirrors 20 and 21 and a plurality of reflection mirrors 23 and 24.

Respective color image data (raster data) are sequentially output from the image processing system 12 to the exposure devices 14Y, 14M, 14C, and 14K of the image forming units 13Y, 13M, 13C, and 13K corresponding to yellow (Y), magenta (M), cyan (C), and black (K). The surfaces of the respective photosensitive drums 15Y, 15M, 15C, and 15K are scanned and exposed with laser beams LB which are emitted from the exposure devices 14Y, 14M, 14C, and 14K in accordance with the image data, so that electrostatic latent images are formed on the surfaces of the respective photosensitive drums. The electrostatic latent images formed on the photosensitive drums 15Y, 15M, 15C, and 15K are developed as toner images corresponding to colors, that is, yellow (Y), magenta (M), cyan (C), and black (K) by the corresponding developing devices 17Y, 17M, 17C, and 17K.

Unfixed toner images, which correspond to yellow (Y), magenta (M), cyan (C), and black (K) and are sequentially formed on the photosensitive drums 15Y, 15M, 15C, and 15K of the image forming units 13Y, 13M, 13C, and 13K, are sequentially transferred to the surface of an intermediate transfer belt 25 at initial transfer positions where the photosensitive drums 15Y, 15M, 15C, and 15K come in contact with an intermediate transfer belt 25 functioning as an intermediate transfer body so that the toner images are superimposed on each other. Semiconductive initial transfer rollers 26Y, 26M, 26C, and 26K, which function as transfer members, are provided on the back surface of the intermediate transfer belt 25 at the initial transfer positions. The intermediate transfer belt 25 is put in contact with the surfaces of the photosensitive drums 15Y, 15M, 15C, and 15K by the initial transfer rollers 26Y, 26M, 26C, and 26K. A voltage whose polarity is opposite to the charge polarity of the toner is applied to the initial transfer rollers 26Y, 26M, 26C, and 26K. The respective unfixed toner images, which are formed on the photosensitive drums 15Y, 15M, 15C, and 15K, are sequentially and electrostatically attached to the intermediate transfer belt 25, so that a full-color image is formed. Also, the residual toners which remain on the surfaces of the photosensitive drums 15Y, 15M, 15C, and 15K after transfer are cleaned by the drum cleaning devices 18Y, 18M, 18C, and 18K.

The intermediate transfer belt 25 is stretched with a predetermined tension by a driving roller 27, a driven roller 28, a tension roller 29, a driven roller 30, a backup roller 31 opposite from the secondary transfer device, and an idling roller 32. The intermediate transfer belt is driven so as to circulate at a predetermined speed in a direction indicated by arrow B in synchronization with the rotation of the photosensitive drums 15Y, 15M, 15C, and 15K by a driving roller 27 that is rotationally driven by a dedicated driving motor (not shown) having excellent speed constancy. Further, in this exemplary embodiment, the intermediate transfer belt 25 is made of a material that is obtained by dispersing a conductive material, such as carbon or an ion conductive material, in a resin material, such as a polyimide, polyamide-imide, polycarbonate, or fluorine resins, to impart conductivity.

Meanwhile, when a unicolor image is intended to be formed, only the image forming unit 13Y, 13M, 13C, or 13K corresponding to the desired color is operated, and an unfixed toner image of the desired single color is formed on the intermediate transfer belt 25.

In this way, multiple unfixed toner images in yellow (Y), magenta (M), cyan (C), and black (K) are initially transferred to the intermediate transfer belt 25, and then are conveyed to a secondary transfer position which faces a conveying path of a recording sheet P (recording medium), with the rotation of the intermediate transfer belt 25. Then, the unfixed toner images are secondarily transferred to the recording sheet P from the intermediate transfer belt 25 at the secondary transfer position. The recording sheet P is fed from any one of sheet trays 39, 40, and 41 by feed rollers 42. After that, the recording sheet is conveyed to a resist roller 47 along a sheet conveying path 46 on which a plurality of conveying rollers 43 and 44 is provided, and is stopped once. Then, the recording sheet P is conveyed at a predetermined timing by the resist roller 47, and is interposed between a secondary transfer roller 33 and the intermediate transfer belt 25. Further, a backup roller 31 facing the secondary transfer roller 33 and a metal roller (not shown) coming in contact with the backup roller 31 are provided on the back surface of the intermediate transfer belt 25 at the secondary transfer position. A transfer electric field, which has the secondary transfer roller 33 as an opposite electrode, is formed at the secondary transfer position by applying a voltage (regular transfer bias) with the same polarity as the toner to the metal roller. Accordingly, the unfixed toner images, which are held on the intermediate transfer belt 25, are electrostatically transferred to the recording sheet P at the secondary transfer position. In addition, the secondary transfer roller 33 is cleaned by a brush roller (not shown).

Further, the recording sheet P to which the unfixed toner images are transferred is separated from the intermediate transfer belt 25. Then, the recording sheet is fed to the fixing device 37 by sheet conveying belts 35 and 36 functioning as transfer material conveying units, the unfixed toner images are fixed, and the recording sheet is discharged onto a discharge tray 38 that is provided outside the color electrophotographic copier body 1. Meanwhile, the residual toners remaining on the intermediate transfer belt 25 which has completed the secondary transfer of the unfixed toner images are removed by a belt cleaning device 48 that is positioned downstream of the secondary transfer section.

In this exemplary embodiment, the above-mentioned intermediate transfer belt 25 and the initial transfer rollers 26, which are disposed inside the intermediate transfer belt, are integrated into one unit and detachably attached to the image forming apparatus body 1. Hereinafter, a unit in which the intermediate transfer belt 25 and the like are integrally formed and whose components may be replaced or adjusted, is referred to as an intermediate transfer unit 250.

Figure 2:
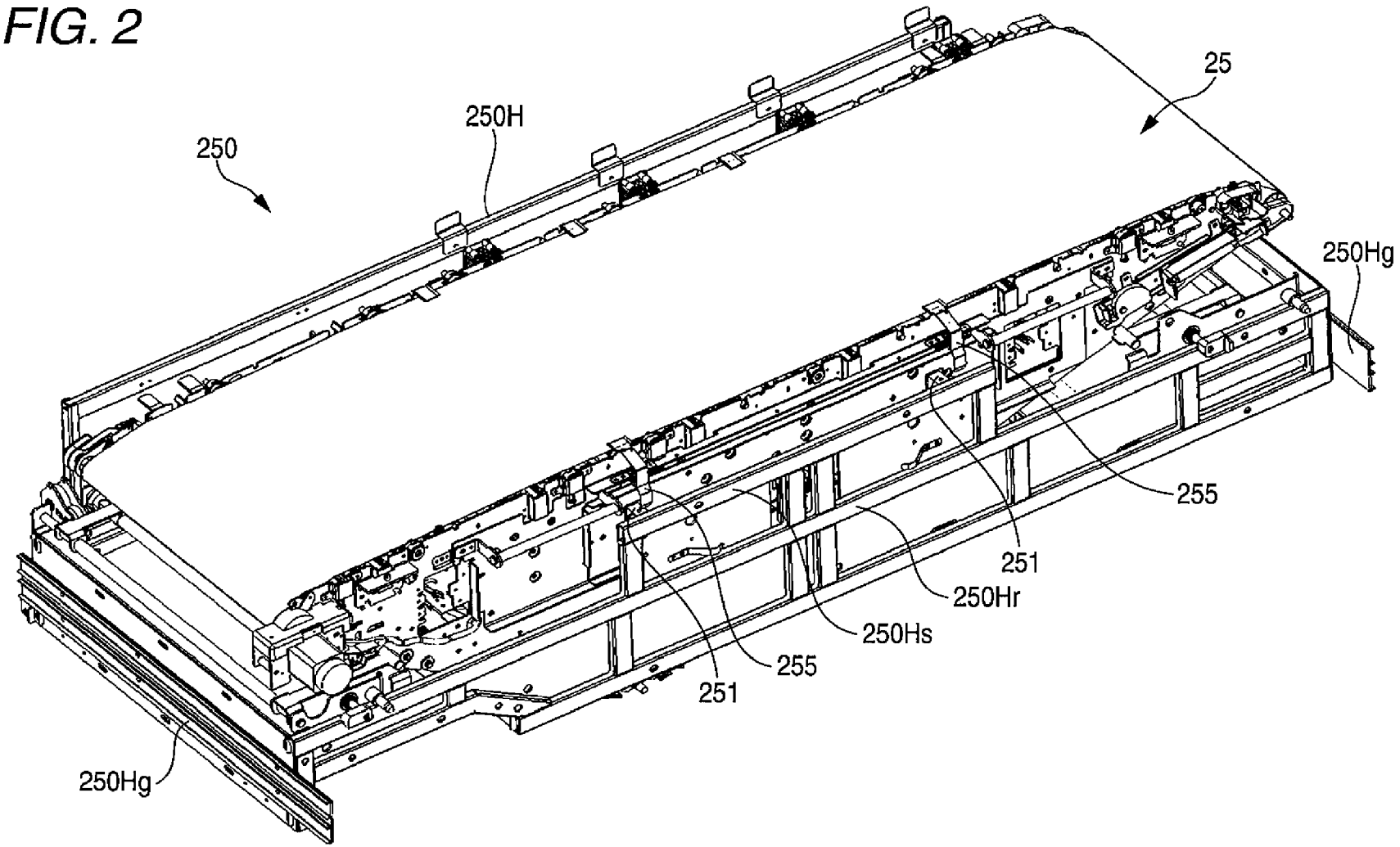
FIG. 2 is a perspective view of an intermediate transfer unit that is received in a unit frame.
Figure 3:
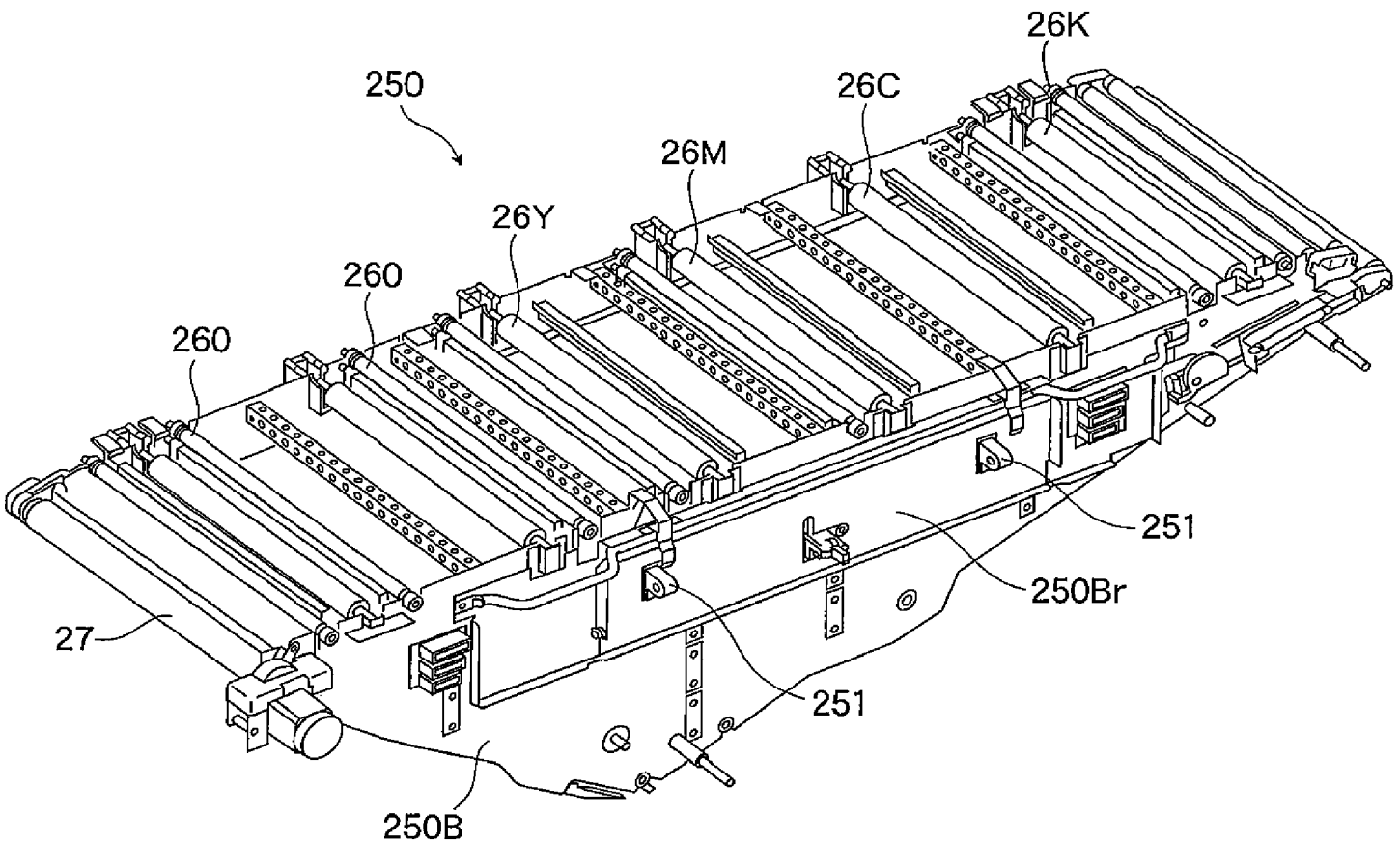
FIG. 3 is a perspective view of the intermediate transfer unit from which an intermediate transfer belt is separated.
Figure 4:
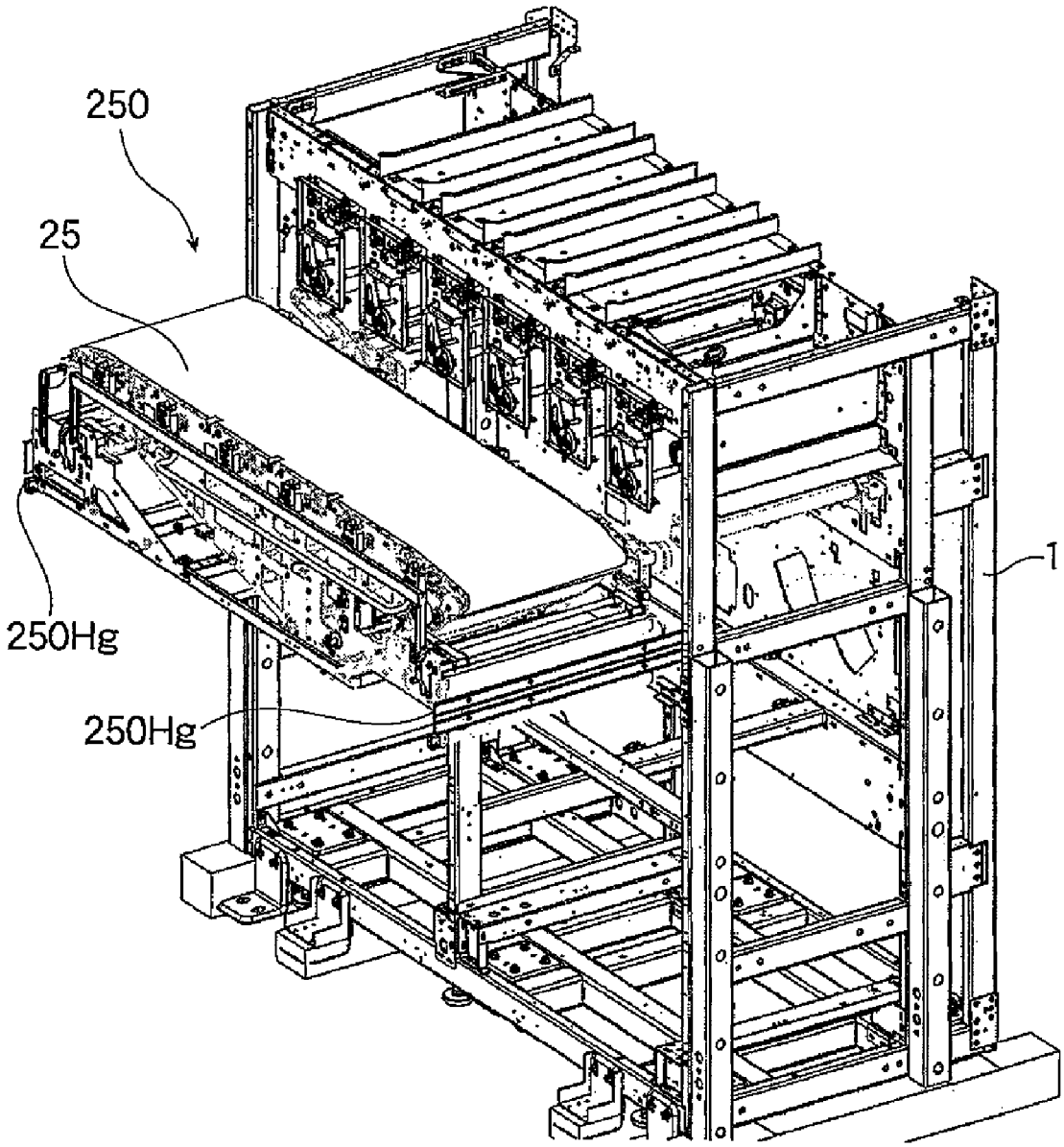
FIG. 4 is a perspective view showing the intermediate transfer unit according to the exemplary embodiment pulled out from the front side of the image forming apparatus together with unit frame.
Figure 5:
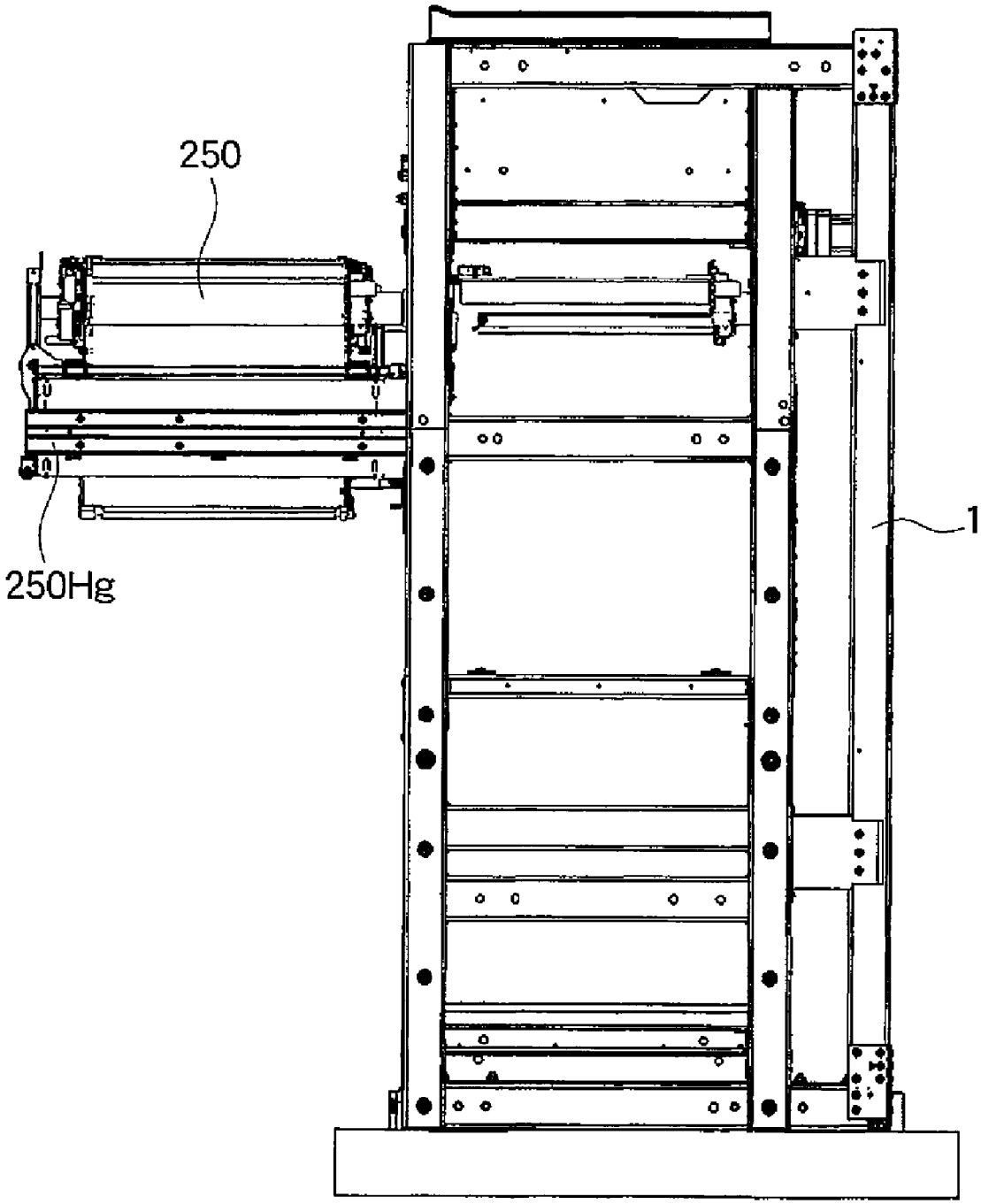
FIG. 5 is a side view showing the intermediate transfer unit according to the exemplary embodiment pulled out from the front side of the image forming apparatus together with the unit frame.
Figure 6:
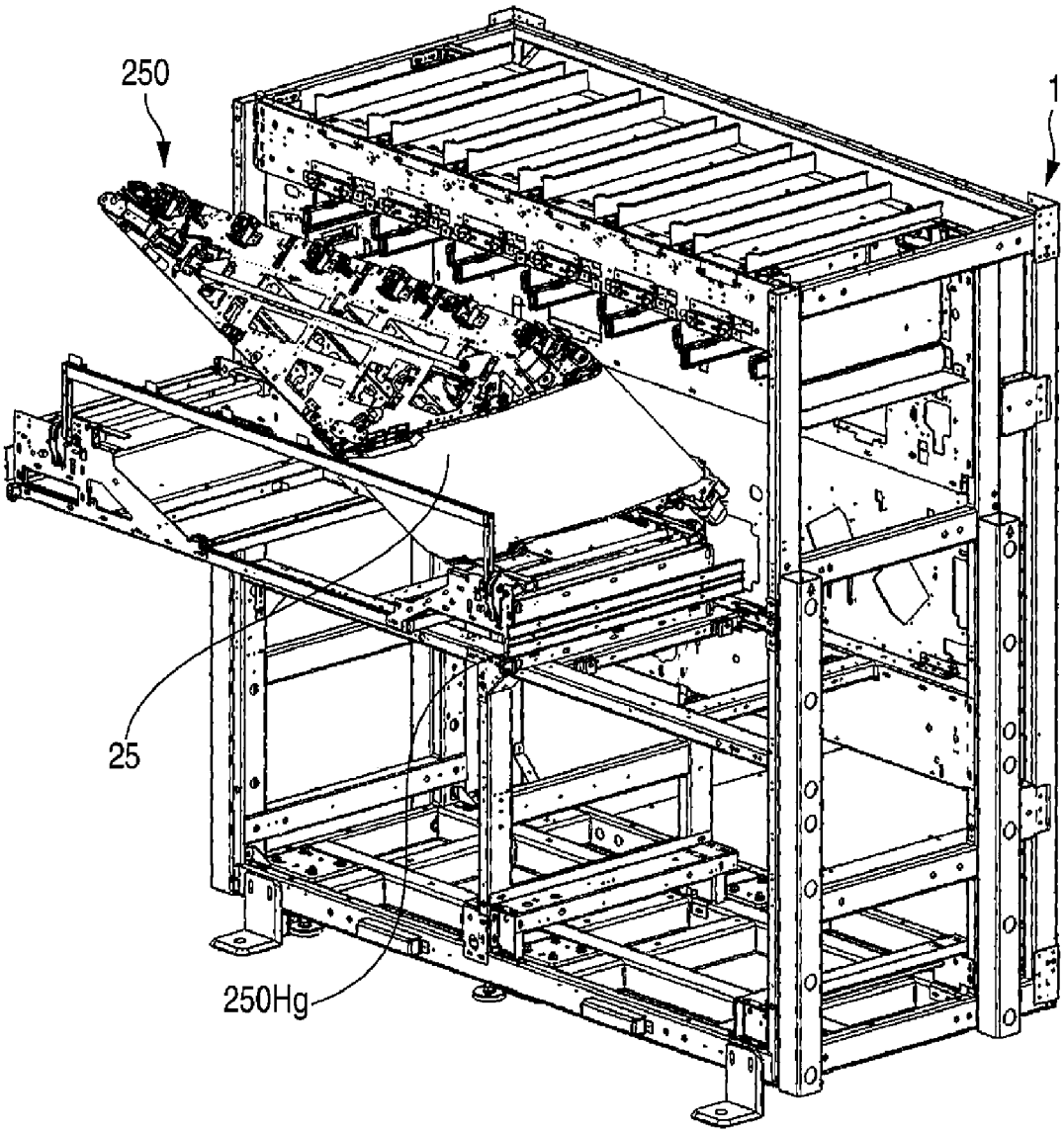
FIG. 6 is a perspective view showing the intermediate transfer unit according to the exemplary embodiment swung upward with respect to the unit frame.
Figure 7:
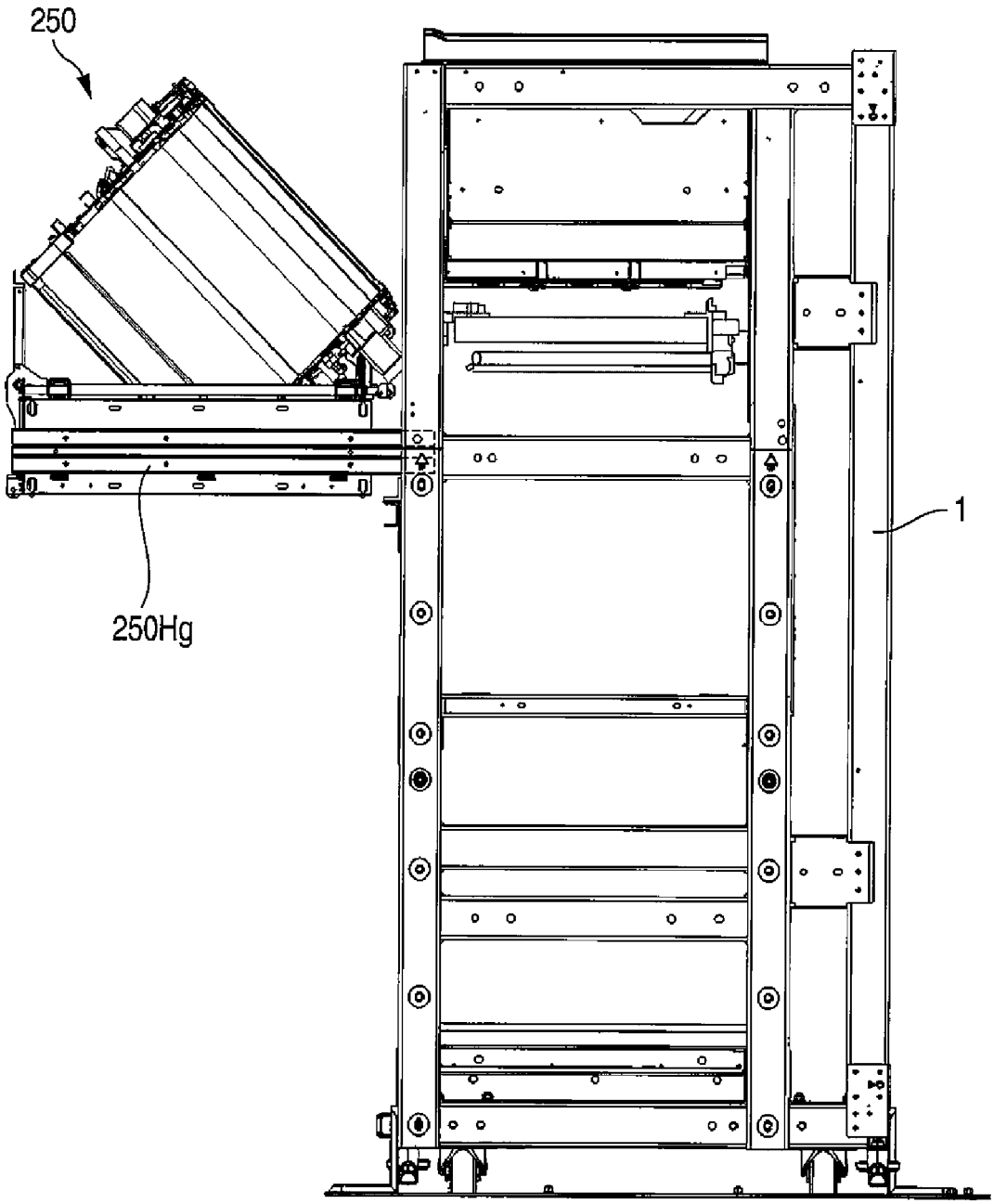
FIG. 7 is a side view showing the intermediate transfer unit according to the exemplary embodiment swung upward with respect to the unit frame.

The intermediate transfer unit 250 according to this exemplary embodiment will be described below with reference to FIGS. 2 to 7. Herein, FIG. 2 is a perspective view of the intermediate transfer unit 250 that is received in a unit frame 250H, and FIG. 3 is a perspective view of the intermediate transfer unit 250 from which the intermediate transfer belt 25 is separated. Further, FIG. 4 is a perspective view showing the intermediate transfer unit 250 according to this exemplary embodiment which has been pulled out from the front side of the image forming apparatus body 1 together with the unit frame 250H, and FIG. 5 is a side view of the same. FIG. 6 is a perspective view showing the intermediate transfer unit 250 which has been swung upward with respect to the unit frame 250H, and FIG. 7 is a side view of the same.

First, as shown in FIGS. 2 and 3, the intermediate transfer unit 250 according to this exemplary embodiment includes the endless intermediate transfer belt 25, and a belt support 250B that supports the intermediate transfer belt so as to allow the intermediate transfer belt 25 to rotate and has a substantially triangular cross section. Specifically, as shown best in FIG. 3, the initial transfer rollers 26Y, 26M, 26C, and 26K, the driving roller 27, a plurality of support rollers 260, and the like, which are disposed inside the intermediate transfer belt 25, are rotatably supported by the belt support 250B. The intermediate transfer belt 25 is rotatably supported by these rollers. Meanwhile, by sliding in the width direction (a direction orthogonal to a longitudinal direction) of the belt support 250B, the intermediate transfer belt 25 of this exemplary embodiment may be separated.

Further, as shown best in FIG. 2, the intermediate transfer unit 250 according to this exemplary embodiment may be received in the unit frame 250H that is a frame-like housing forming a part of the image forming apparatus body 1, and is formed to be swingable upwards with respect to the unit frame 250H. Specifically, two protruding portions 251 and 251 having through holes are formed on a back surface 250Br of the belt support 250B that supports the intermediate transfer belt 25. The intermediate transfer unit 250 may be swung about a rotating shaft (not shown), which extends in a longitudinal direction and is inserted into the through holes of the pair of protruding portions 251 and 251, with respect to the unit frame 250H.

Further, guide rails 250Hg, which extend in a front-back direction, are provided at a lower portion of the side surfaces of the unit frame 250H. The intermediate transfer unit 250 is pulled out from the front side of the apparatus for each unit frame 250H along the guide rails 250Hg (see FIGS. 4 and 5). If the intermediate transfer unit 250 is pulled out from the front side of the apparatus and the front portion of the 10 intermediate transfer unit 250 is lifted so as to rotate with respect to the unit frame 250H, the intermediate transfer unit 250 is exposed to the outside away from the unit frame 250H (see FIGS. 6 and 7). Accordingly, it may be possible to perform maintenance, such as the replacement of the intermediate transfer belt 25 or the adjustment of components. Meanwhile, in this exemplary embodiment, in terms of the improvement of the workability, the inclined attitude of the intermediate transfer unit 250 is maintained by a support mechanism that is known in the related art while the intermediate transfer unit 250 is rotated with respect to the unit frame 250H by a predetermined angle.

Meanwhile, a plate-like contact bar 250Hs, which comes in contact with the belt protecting member 255 to be described below, is provided in the longitudinal direction of the intermediate transfer belt 25 on the back surface 250Hr of the unit frame 250H (the surface of the unit frame 250H opposite from the back surface 250Br of the belt support 250B).

Further, in this exemplary embodiment, a plurality of belt protecting members 255 is disposed along the longitudinal direction of the intermediate transfer belt 25 on the back surface 250Br of the belt support 250B (on the back surface of the intermediate transfer belt 25) of the intermediate transfer unit 250 so that the ends of the belt protecting members are positioned above the near edge of the intermediate transfer belt 25 in the width direction (see FIGS. 2 and 3). Meanwhile, the same belt protecting members 255 may be provided on the front surface of the belt support 250B (across from the intermediate transfer belt 25 in the width direction). However, since the workability does not deteriorate on the front surface of the intermediate transfer belt 25 as much as on the back surface thereof, belt protecting members (not shown) which are screwed as in the related art are provided on the front surface of the belt support 250B of this exemplary embodiment.

Figure 8:
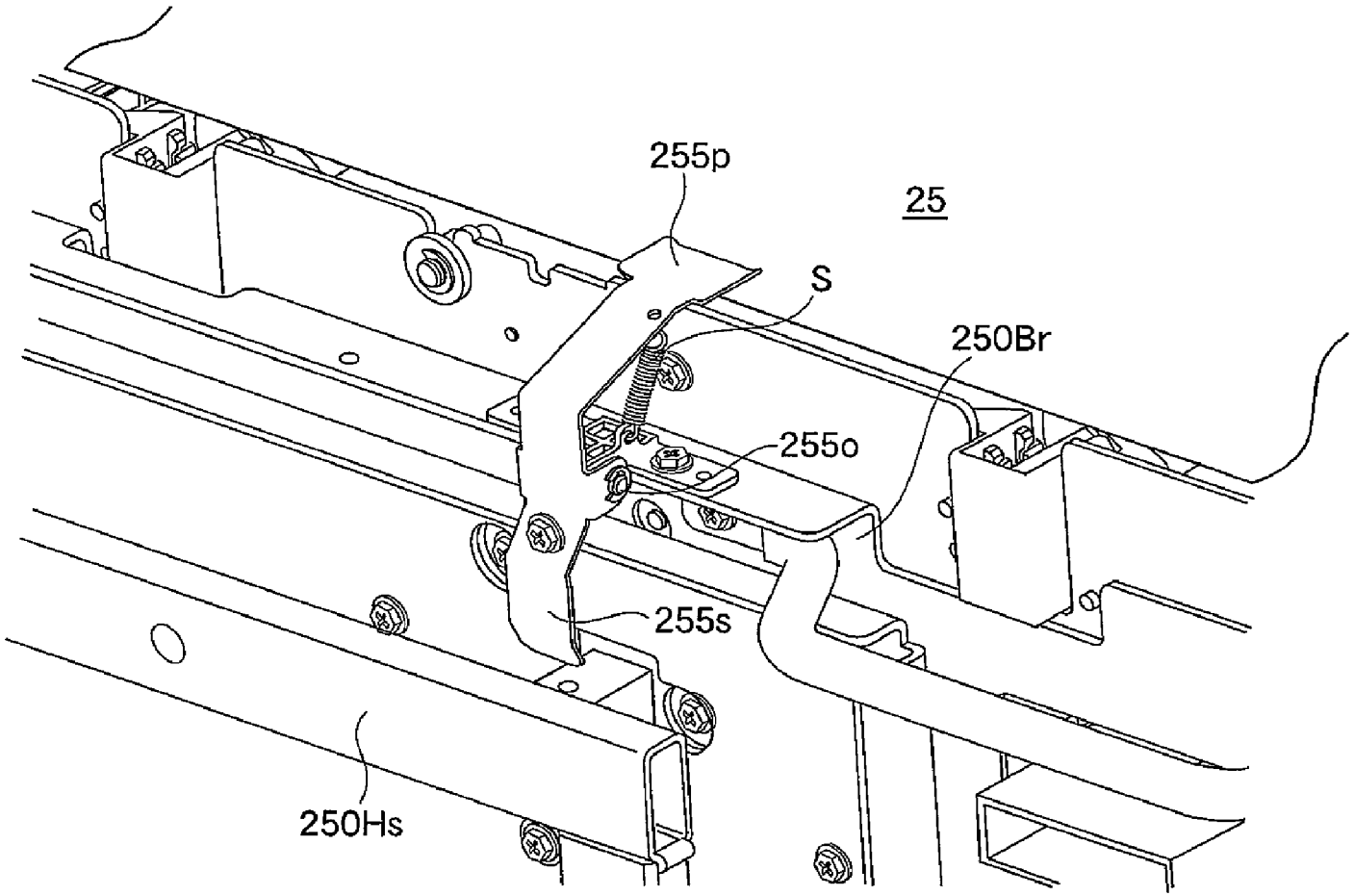
FIG. 8 is a perspective view showing the state of a belt protecting member when the intermediate transfer unit 250 according to the exemplary embodiment is normally mounted.
Figure 9:
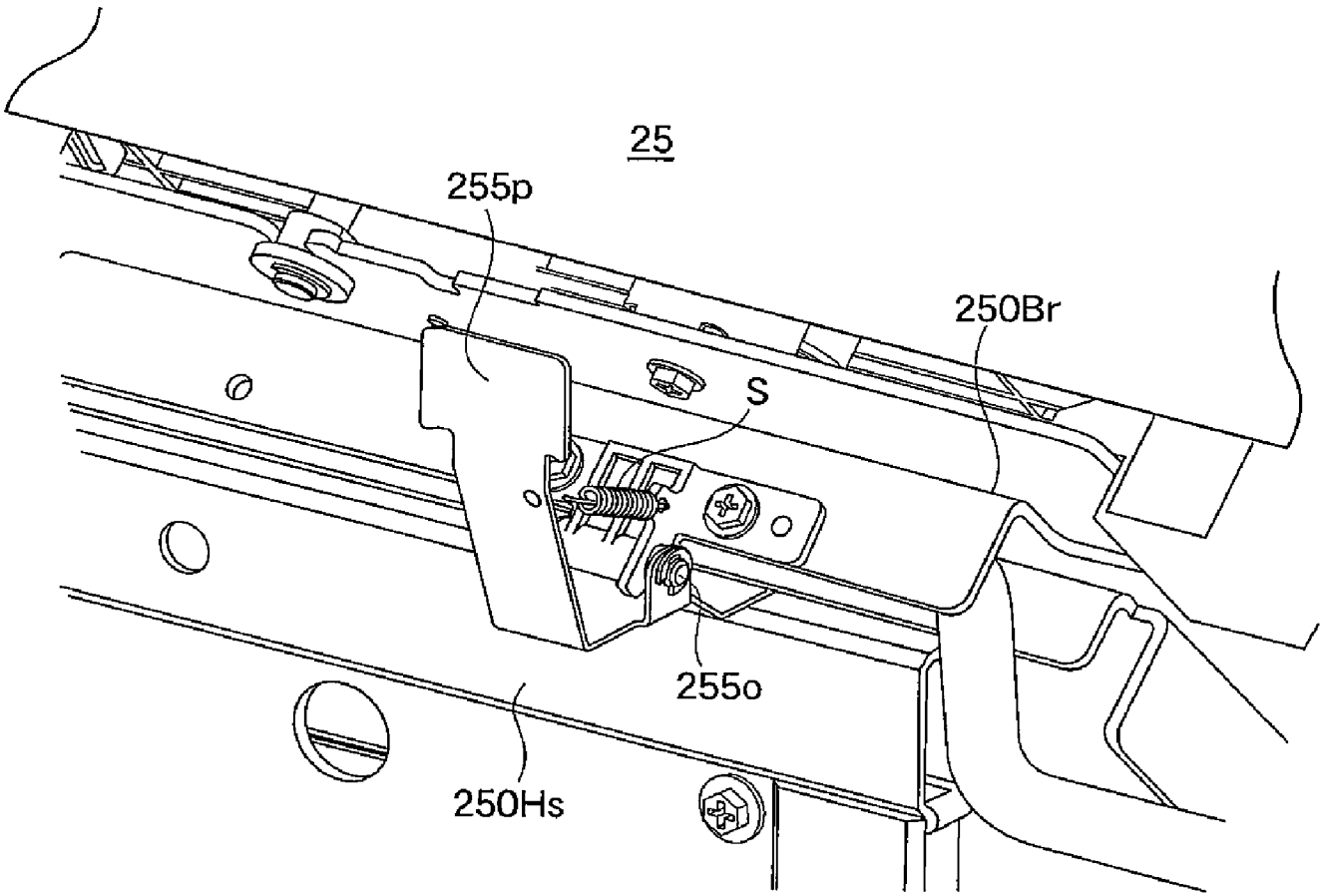
FIG. 9 is a perspective view showing the state of the belt protecting member when the intermediate transfer unit according to the exemplary embodiment is swung upward with respect to the unit frame.
Figure 10:
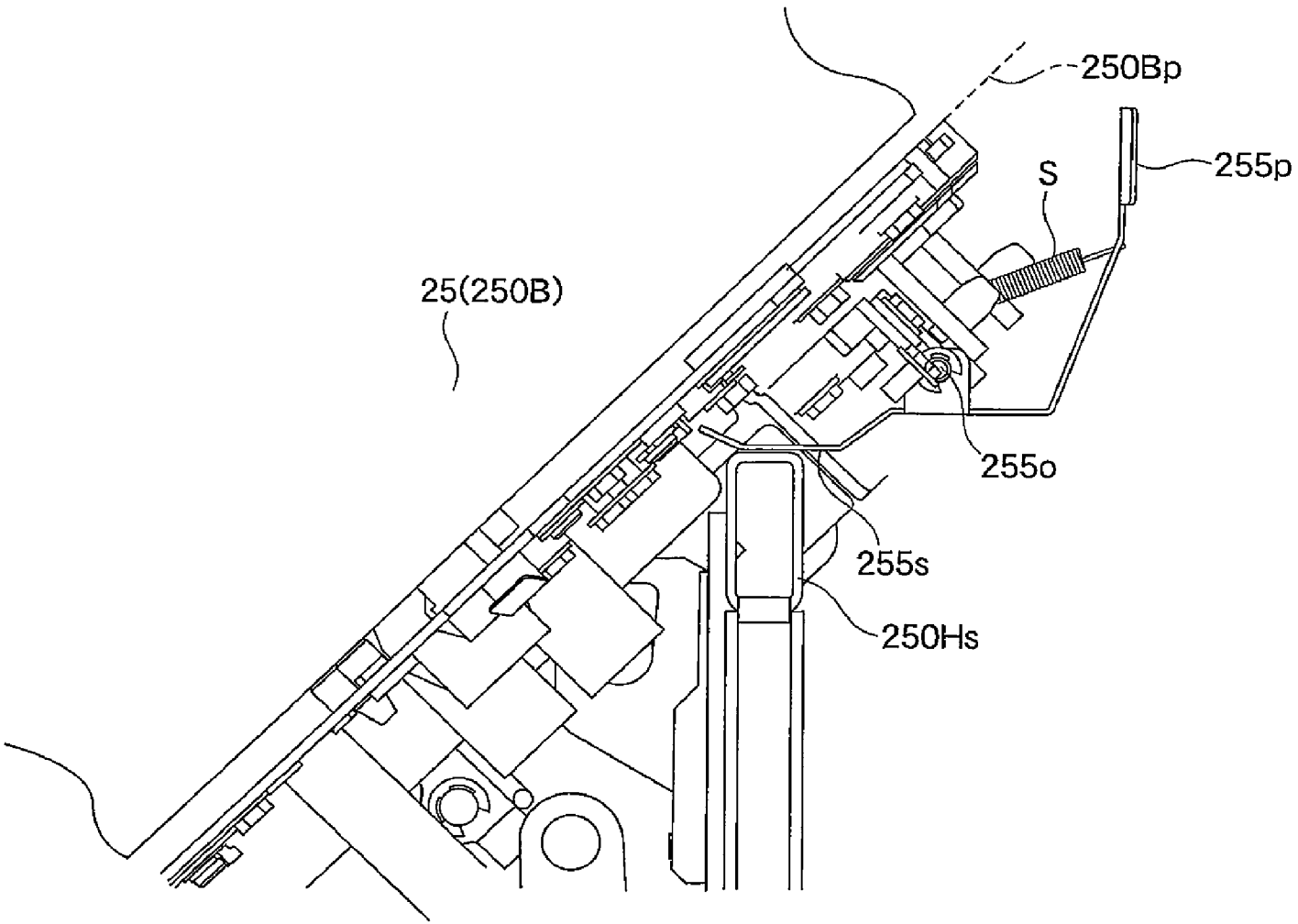
FIG. 10 is a side view showing the state of the belt protecting member when the intermediate transfer unit according to the exemplary embodiment is swung upward with respect to the unit frame.
Figure 11:
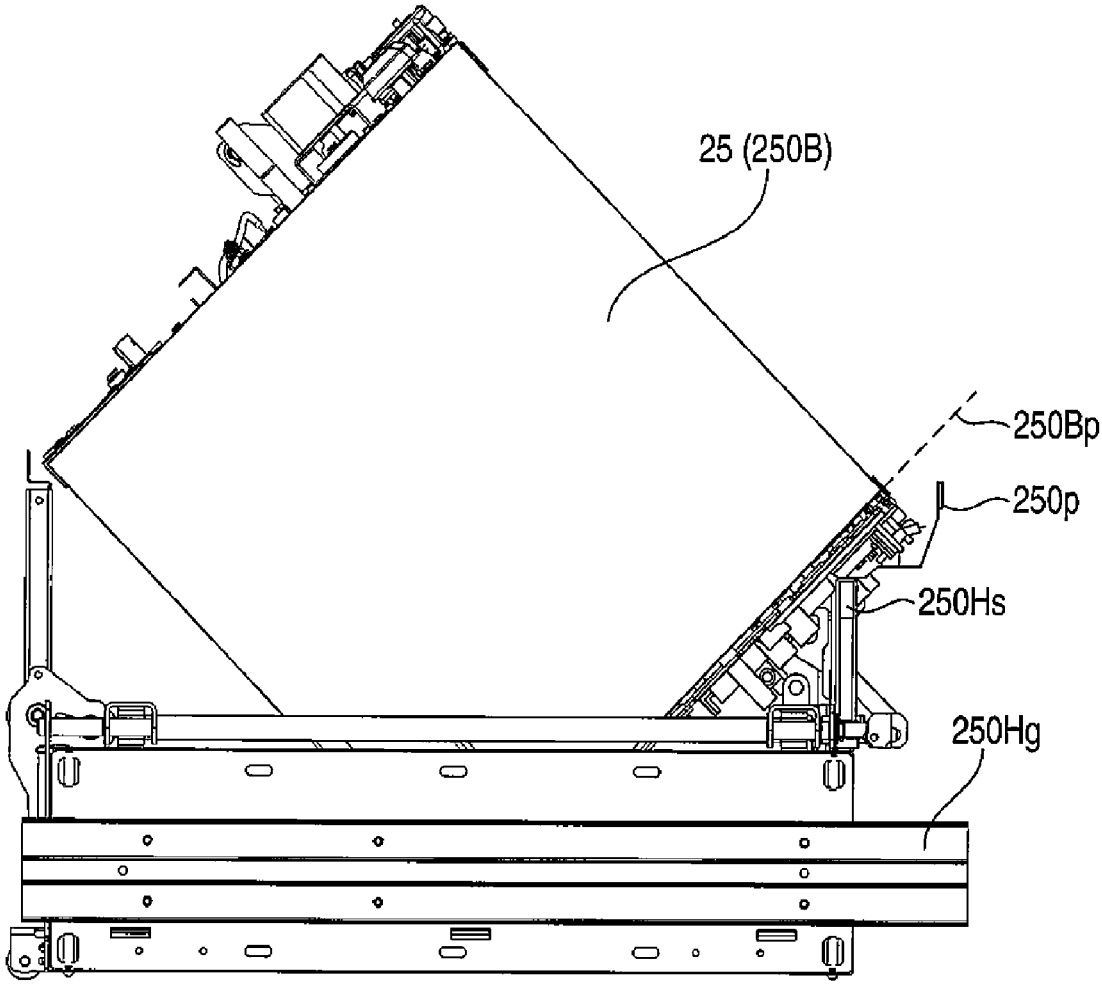
FIG. 11 is a side view showing the state of the belt protecting member when the intermediate transfer unit according to the exemplary embodiment is swung upward with respect to the unit frame.

If an edge of the intermediate transfer belt 25 in the width direction curls upwards due to aging or the like (when an edge in the width direction is bent upward), the belt protecting member 255 prevents the edge from coming in contact with other components, thereby protecting the intermediate transfer belt 25. The structure of the belt protecting member 255 of this exemplary embodiment will be described below with reference to FIGS. 8 to 11. Herein, FIG. 8 is a perspective view showing the state of the belt protecting member 255 when the intermediate transfer unit 250 is normally mounted. FIG. 9 is a perspective view showing the state of the belt protecting member 255 when the intermediate transfer unit 250 is swung upward with respect to the unit frame 250H. FIGS. 10 and 11 are side views showing the state of the belt protecting member 255 when the intermediate transfer unit 250 is swung upward with respect to the unit frame 250H.

As shown best in FIGS. 8 and 9, the belt protecting member 255 of this exemplary embodiment is a plate-like member that is rotatable about a fulcrum 255*o* mounted on the back surface 250Br of the belt support 250B. A protecting portion 255*p* parallel to the surface of the intermediate transfer belt 25 is formed at one end of the belt protecting member, and a contact surface 255*s* parallel to the back surface 250Br of the belt support 250B is formed at the other end of the belt protecting member. Further, when the belt support 250B on which the intermediate transfer belt 25 is mounted is mounted in the unit frame 250H, the protecting portion 255*p* formed at the end of the belt protecting member 255 is biased by an elastic member S so as to be parallel to and above the edge of the intermediate transfer belt 25 in the width direction.

On the other hand, when the intermediate transfer unit 250 is pulled out from the image forming apparatus body 1 and swung (rotated) up with respect to the unit frame 250H at the time of maintenance such as the replacement of the belt, as shown in FIGS. 9 to 11, the contact surface 255*s* of the belt protecting member 255 comes in contact with the contact bar 250Hs of the unit frame 250H and is rotated in the direction opposite to the biasing direction (toward the intermediate transfer belt 25) and the protecting portion 255*p* formed at the end of the belt protecting member is withdrawn to the outside of the support 250B for supporting the intermediate transfer belt 25.

Specifically, when the contact surface 255*s* of the belt protecting member 255 rides on the upper portion (top surface) of the contact bar 250Hs of the unit frame 250H, the protecting portion 255*p* formed at the end of the belt protecting member is moved to an area formed outside a plane 250Bp including at least the back surface 250Br of the support 250B (on the side of this plane opposite to the intermediate transfer belt 25).

According to the intermediate transfer unit 250 having the above-mentioned structure, when the intermediate transfer belt 25 (belt support 250B) is received in the unit frame 250H, as shown in FIGS. 2 and 8, the protecting portion 255*p* formed at the end of the belt protecting member 255 is disposed parallel to the surface of the intermediate transfer belt 25 so as to cover the vicinity of the edge of the intermediate transfer belt 25 in the width direction. Accordingly, it may be possible to suppress the aging deformation (curling) of the intermediate transfer belt 25 and to prevent the edges of the intermediate transfer belt from coming in contact with adjacent components. As a result, it may be possible to protect the intermediate transfer belt 25 from accidental damage.

Further, while the belt support 250B is swung (rotated) upward with respect to the unit frame 250H at the time of maintenance such as the replacement of the intermediate transfer belt 25, the belt protecting member 255 is withdrawn outside of the back surface 250Br of the belt support 250B. Accordingly, it may be possible to reliably avoid the interference between the intermediate transfer belt 25 and the belt protecting member 255 when the intermediate transfer belt is attached and detached. As a result, it may be possible to reliably prevent wrong installation or the like, for example, prevent the intermediate transfer belt 25 from riding on the belt protecting member 255. In addition, it may be possible to significantly improve the workability at the time of maintenance in comparison with the belt protecting member that is screwed in the related art.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An intermediate transfer unit comprising:

an intermediate transfer belt that is configured to be rotated, a toner image being transferred to a surface of the intermediate transfer belt;

a belt support that supports the intermediate transfer belt so as to allow the intermediate transfer belt to be replaceable;

a housing that receives the belt support on which the intermediate transfer belt is mounted; and a belt protecting member that is provided on the belt support and is urged by elastic member so as to cover edge of the intermediate transfer belt in a width direction thereof, wherein:

the belt support is formed to be swingable with respect to the housing, an end of the belt protecting member is positioned so as to cover the edge of the intermediate transfer belt in the width direction while the belt support is received in the housing, and the end of the belt protecting member is withdrawn to an outside of the belt support while the belt support is swung with respect to the housing.

2. The intermediate transfer unit according to claim 1, wherein:

the belt protecting member is provided on a back surface of the belt support, and the belt support is formed to be swingable at a back surface thereof with respect to the housing.

3. The intermediate transfer unit according to claim 1, wherein:

the belt protecting member is formed to be rotatable, one end of the belt protecting member is urged toward the intermediate transfer belt, and a contact surface, that comes in contact with the housing in accordance with swing of the belt support, is formed at the other end of the belt protecting member.

4. An image forming apparatus comprising:

an intermediate transfer unit comprising:

an intermediate transfer belt that is configured to be rotated, a toner image being transferred to a surface of the intermediate transfer belt;

a belt support that supports the intermediate transfer belt so as to allow the intermediate transfer belt to be replaceable;

a housing that receives the belt support on which the intermediate transfer belt is mounted;

a belt protecting member that is provided on the belt support and is urged by elastic member so as to cover edge of the intermediate transfer belt in a width direction thereof, wherein:

the belt support is formed to be swingable with respect to the housing, end of the belt protecting member is positioned so as to cover the edge of the intermediate transfer belt in the width direction while the belt support is received in the housing, and the end of the belt protecting member is withdrawn to an outside of the belt support while the belt support is swung with respect to the housing; and an image forming unit that forms an image on a recording medium.

5. The intermediate transfer unit according to claim 1, wherein the end of the belt protecting member is rotated away from the intermediate transfer belt while the end of the belt protecting member is withdrawn to the outside of the belt support while the belt support is swung with respect to the housing.

6. The intermediate transfer unit according to claim 1, wherein the intermediate transfer belt is configured to be rotated along a rotation direction, and wherein the end of the belt protecting member is rotated about a rotation axis that extends parallel to the rotation direction.

* * * * *